United States Patent [19]

Harrington

[11] Patent Number: 4,635,728

[45] Date of Patent: Jan. 13, 1987

[54] METHOD AND APPARATUS FOR CONNECTING A TUBULAR ELEMENT TO AN UNDERWATER WELLHEAD

[75] Inventor: John P. Harrington, Houston, Tex.

[73] Assignee: Amoco Corporation, Chicago, Ill.

[21] Appl. No.: 760,700

[22] Filed: Jul. 30, 1985

[51] Int. Cl.[4] ..... E21B 43/013

[52] U.S. Cl. ..... 166/341; 166/345; 285/24; 285/330

[58] Field of Search ..... 166/338, 339, 341, 342, 166/344, 345, 349, 351, 359, 360, 365, 368, 379, 380, 85, 77.5; 285/24, 27, 342, 343, 18, 39, 330, 31, 32, 143, 145, DIG. 21

[56] References Cited

U.S. PATENT DOCUMENTS

| | | | |
|---|---|---|---|
| 3,025,912 | 3/1962 | Schramm et al. | 166/85 |
| 3,032,125 | 5/1962 | Hiser et al. | 285/DIG. 21 |
| 3,248,135 | 4/1966 | Meripol | 285/343 |
| 3,256,937 | 6/1966 | Haeber et al. | 166/344 |
| 3,287,030 | 11/1966 | Crain et al. | 285/18 |
| 3,288,493 | 11/1966 | Brown | 166/345 |
| 3,353,847 | 11/1967 | Brown | 285/DIG. 21 |
| 4,343,493 | 8/1982 | Nobilean et al. | 285/39 |

*Primary Examiner*—James A. Leppink
*Assistant Examiner*—Hoang C. Dang
*Attorney, Agent, or Firm*—Scott H. Brown; Fred E. Hook

[57] ABSTRACT

A method and apparatus for connecting a tubular element to an underwater wellhead. A wellhead extension having a threaded lower end is threadably connected to an underwater wellhead. A stinger connected to a lower end of a string of riser pipe is lowered into the wellhead extension until the riser pipe is sealably connected to the extension spool. In the event of damage to the hanger threads, a housing is mounted on the lower end of a string of riser pipe or a wellhead extension. A substantially tubular nut is threadably engaged with the housing and includes a set of downwardly-projecting lugs on the lower end of the nut. On the lower portion of the housing, a set of slips and an annular seal are mounted. The housing is lowered until the lugs are engaged with flow-by ports in the wellhead hanger. Rotation of the pipe effects longitudinal housing movement relative to the nut which sets the slips thereby joining the housing to the hanger, and energizes the seal between the wellhead and the housing.

18 Claims, 9 Drawing Figures

METHOD AND APPARATUS FOR CONNECTING A TUBULAR ELEMENT TO AN UNDERWATER WELLHEAD

BACKGROUND OF THE INVENTION

1. Field of the Invention

The present invention relates to methods and apparatus for connecting a tubular element such as a riser pipe to an underwater wellhead and, more particularly, to such methods and apparatus which can be used in the event of misalignment of the riser pipe and wellhead and/or in the event of wellhead internal thread damage.

2. Setting of the Invention

A well-known configuration for an offshore oil or gas well drilled from a temporary platform, such as a jack-up or semisubmersible drilling rig, is known as a mud-line suspension well. In drilling such a well, a large tubular conductor is first driven into the sea floor. The conductor includes an annular shoulder formed on the radially inner surface thereof near the top of the conductor with the shoulder being a few feet above the sea floor. The well is drilled through the conductor and after which a series of casing strings are suspended from the conductor. The largest string includes a "hanger" at the top thereof which comprises a pair of annular shoulders, one on the radially inner surface and one, known as a collar, on the radially outer surface. The string is lowered into the wellbore with the collar being set on the conductor shoulder thereby suspending the string in the bore. Flow-by ports or channels in the collar permit fluid flow in the annulus between the casing string and the conductor, as is necessary during cementing and other completion operations. Additional casing hangers having similar collars and radially inner shoulders may be concentrically suspended within the first-installed casing string in a manner similar to the installation of the first hanger in the conductor.

After all of the casing hangers are in place and cemented, each of the casing strings can be extended upwardly to the deck of a platform (set over the well) by means of concentric tie-back casing strings for production of oil and gas from the well to the platform. Usually, the initial connection between an underwater wellhead and the platform is made by a string of riser pipe having a set of threads at the lower end thereof. The riser pipe string is lowered to the wellhead through guides which are fixed at various elevations within the platform. The threaded lower end of the riser is landed in the wellhead and rotated to threadably engage the riser with threads formed on the upper end of the largest casing hanger. Thereafter, a tie-back casing string for engagement with the casing string which is suspended from the largest hanger is lowered through the riser and threadably engaged with its corresponding casing string. Additional strings of tieback casing are lowered and threadably engaged with casing strings at the wellhead as described above until each of the casing strings is connected to the platform through the riser.

Several problems exist in the above-described method of making the initial riser connection to the wellhead. For a number of possible reasons, the riser may approach the wellhead with a slight lateral offset or at an angle, or both. Under such circumstances, the weight and lack of flexibility of the riser pipe may prevent the riser threads from engaging the wellhead threads. Alternatively, if engagement is attempted under such circumstances, damage to the internal threads in the wellhead can result which can prevent connecting the casing strings in the bore of the platform.

Even under circumstances when the riser is in proper lateral and angular alignment with the wellhead, if it should be lowered too rapidly, the tremendous weight of the riser can damage the wellhead threads. It should also be noted that wellhead thread damage can occur prior to the installation of the riser due to other reasons, including improper installation or removal of corrosion caps which are generally threadably engaged with the larger hanger after the well is drilled.

There exists a need for a method and apparatus for connecting a riser to a wellhead. Moreover, there exists a need for such a method and apparatus in which the threads on the lower end of the riser may be selectively oriented to facilitate alignment with the wellhead threads.

There also exists a need for making a riser connection to a wellhead after the hanger threads have been damaged.

SUMMARY OF THE INVENTION

The present invention comprises a novel method and apparatus for connecting a tubular element such as a string of riser pipe or to an underwater wellhead. One aspect of the invention comprises a wellhead extension which may be rotatably connected at its lower end to the wellhead. A string of riser pipe is made up with a stinger at it lower end. The stinger is lowered into the wellhead extension and thereafter the riser is further lowered until it is sealably connected to the wellhead extension.

Another aspect of the invention enables connection of either the above-mentioned wellhead extension or a riser pipe, depending upon which method of connection to the wellhead is chosen. The housing has an interior diameter sufficient to permit the lower end of the housing to fit over the wellhead on the upper end of the largest casing string inside the conductor. A substantially tubular nut is threadable engaged with the radially outer side of the housing. On the lower end of the nut, a set of lugs extend downwardly for engagement with the flow-by ports in the collar when the housing is lowered over the wellhead. A set of slips and an O-ring-type elastomeric seal are mounted on the lower portion of the housing adjacent to the radially inner surface of the nut. When the housing is lowered over the casing string and the lugs engage the flow-by ports, rotation of the housing in the appropriate direction effects longitudinal housing movement relative to the nut, which compresses and sets the slips, and seals the wellhead to the housing. This seal makes the connection between the wellhead and riser pressure tight.

The present invention is particularly useful for connecting a string of riser pipe from a mudline suspension well to a platform deck above the water surface.

DETAILED DESCRIPTION OF THE PREFERRED EMBODIMENT

The present invention provides a method and apparatus for connecting a tubular element, e.g., a riser pipe, to an underwater wellhead. One aspect of the invention contemplates connecting a wellhead extension to the wellhead. A riser pipe string having a stinger mounted on the lower end thereof is lowered until the stinger is received within the wellhead extension. Thereafter the riser pipe is further lowered until it is sealably connected to the wellhead extension.

In another aspect of the invention, apparatus is provided for connecting a tubular element, e.g., a riser pipe or wellhead extension, to an underwater wellhead on the upper end of a casing string suspended in the conductor by an annular collar formed on the radially outer side of the casing string. The collar includes flow-by ports to permit fluid flow along the radially outer side of the casing string during cementing operations. The apparatus includes a housing having an interior diameter of a size sufficient to permit the housing to fit over the wellhead. A substantially tubular nut is threadably engaged with the radially outer side of the housing. A set of lugs mounted on the lower end of the nut are adapted for engagement with the flow-by ports. On the lower portion of the housing adjacent the radially inner surface of the nut, a set of slips and an elastomeric O-ring seal are mounted. When the housing is fitted over the upper end of the casing string and the lugs are engaged with the flow-by ports, the housing may be rotated to effect longitudinal movement of the housing relative to the nut thereby compressing and setting the slips and compressing the O-ring seal between the housing and the wellhead, thus making the connection between the riser and the wellhead pressure tight.

Figure 1:
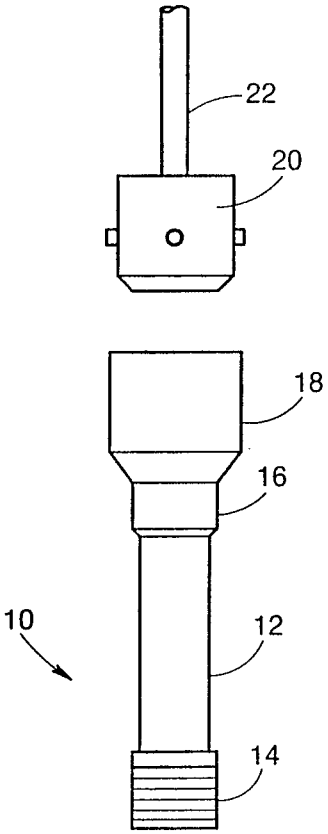
FIG. 1 is a side elevational view of a drill pipe and running tool and of a portion of the preferred embodiment of the apparatus of the instant invention.

Referring now to the drawings, and particularly to FIG. 1, indicated generally at 10 is a portion of the preferred embodiment of the apparatus of the instant invention. Included therein is a wellhead extension 12, such comprising a tube having upper and lower end through which fluid may flow. Mounted on the lower end of wellhead extension 12, such comprising a tube having upper and lower ends through which fluid may flow. Mounted on the lower end of wellhead extension 12 are means for connecting the wellhead extension to a wellhead, also referred to herein as a tie-back tool 14. In the embodiment of the invention shown in FIG. 1, tie-back tool 14. In the embodiment with a set of threads in a wellhead. Mounted on the upper end of wellhead extension 12 is a means for sealably connecting the wellhead extension to a tubular element. In the instant embodiment of the invention, the sealably connecting means is of the type known as a snap connector body 16. Body 16 is commercially available and as will later be discussed in more detail, cooperates with a commercially available snap-type connector pin to make up a joint. Fixedly mounted on body 16 is a running tool receptacle 18, also referred to herein as means for releasable connecting the upper end of said wellhead extension to the lower end of a string of drill pipe. Receptacle 18 cooperates in a well-known manner with a running tool 20 which is mounted on the lower end of a string receptacle, like receptacle 18, which is releasably engaged with the running tool at the surface of the water. The string of drill pipe is then run downwardly thus lowering the tool and the receptacle. When the tool which is suspended from the running tool is engaged with the structure at the wellhead or in the bore, the drill string may be manipulated to disconnect the running tool from its receptacle and the running tool and drill pipe are returned to the surface.

Figure 2:
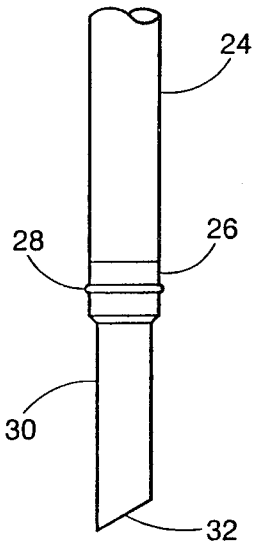
FIG. 2 is a side elevational view of a portion of the preferred embodiment of the apparatus of the instant invention.

Turning to FIG. 2, a tubular element or riser pipe 24, has mounted on the lower end thereof a snap-type connector pin 26. Riser 24 is at the lower end of a string of riser pipe which has been made up on a platform and lowered into water beneath the platform. Riser 24 is of the usual type which connects an underwater wellhead to a platform to effect production of oil and gas from the well.

Pin 26 is designed to cooperate in any known manner with connector body 16. When pin 26 is received within the connector body, or split ring 28 on pin 26 engages with an annular recess (not visible) in connector body 26 which prevents the withdrawal of the pipe from the body thereby making a pipe joint through which fluid may flow. As pin 26 is engaged with body 16, antirotation pins (not visible) in body 16 engage with slots (also not visible) in pin 26 thus preventing relative rotation of pin 26 and body 16. A stinger 30 is mounted on the lower end of pin 26. The stinger is a pipe having a beveled lower end 32 and is of a lesser outside diameter than the inside diameter of wellhead extension 12.

Figure 3:
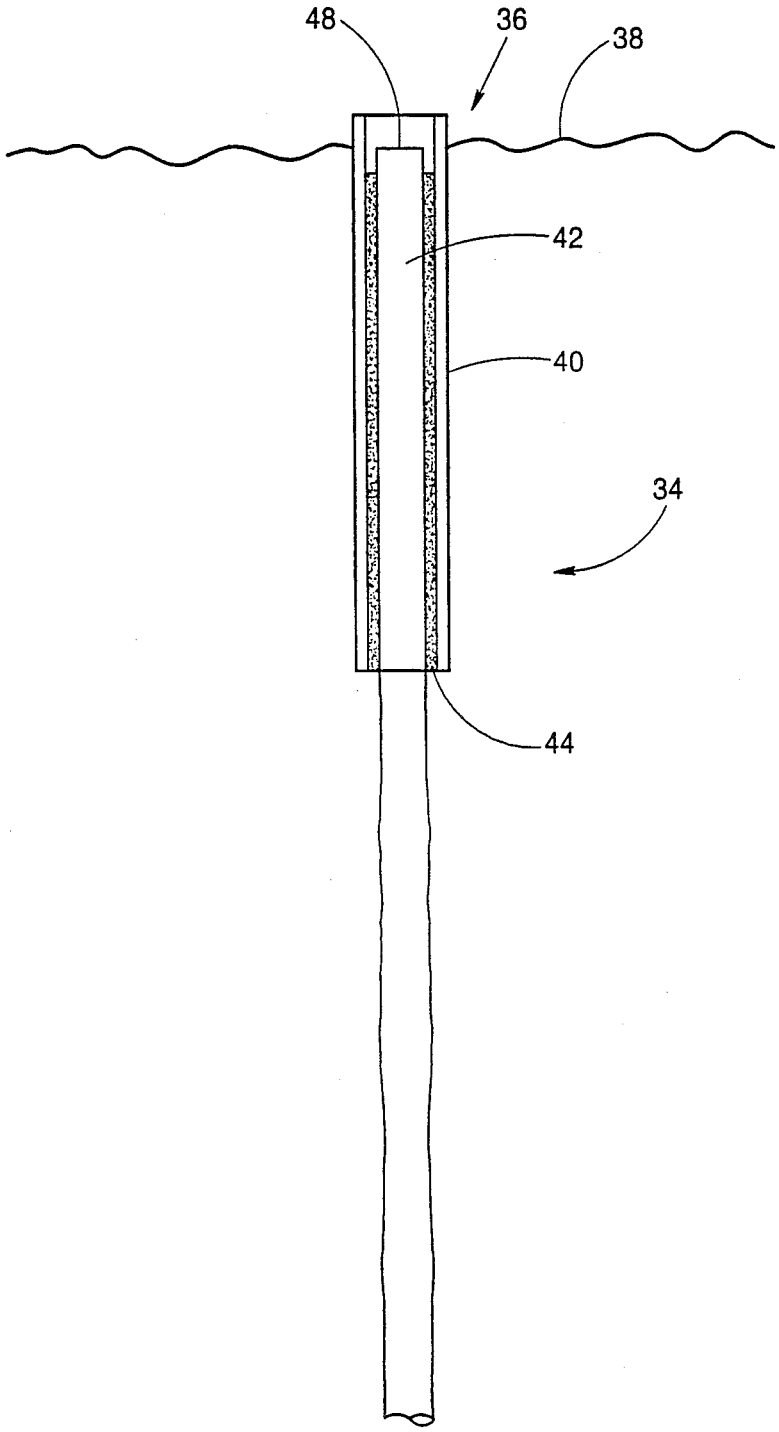
FIG. 3 is a side cross-sectional view of an underwater well after all drilling is completed and before the tie-back operation.

Turning now to FIG. 3, indicated generally at 34 is a view of an underwater well. The view of FIG. 3 shows a well which has been drilled but which has not yet been connected to a platform at the surface of the water. Indicated generally at 36 is the top of the conductor pipe 40 with the wellhead 48 within it. The wellhead is the upper end of the next string of casing inside the conductor, 42 in FIG. 3. The top of the conductor and the wellhead are generally several feet above the ocean floor 38. In drilling well 34, a generally tubular conductor 40 is first pounded into floor 38 to the position shown. Thereafter, drilling is commenced through conductor 40 to the desired depth, casing 42 is placed in the wellbore as shown and is cemented in place in the usual fashion with cement 44.

Figure 4:
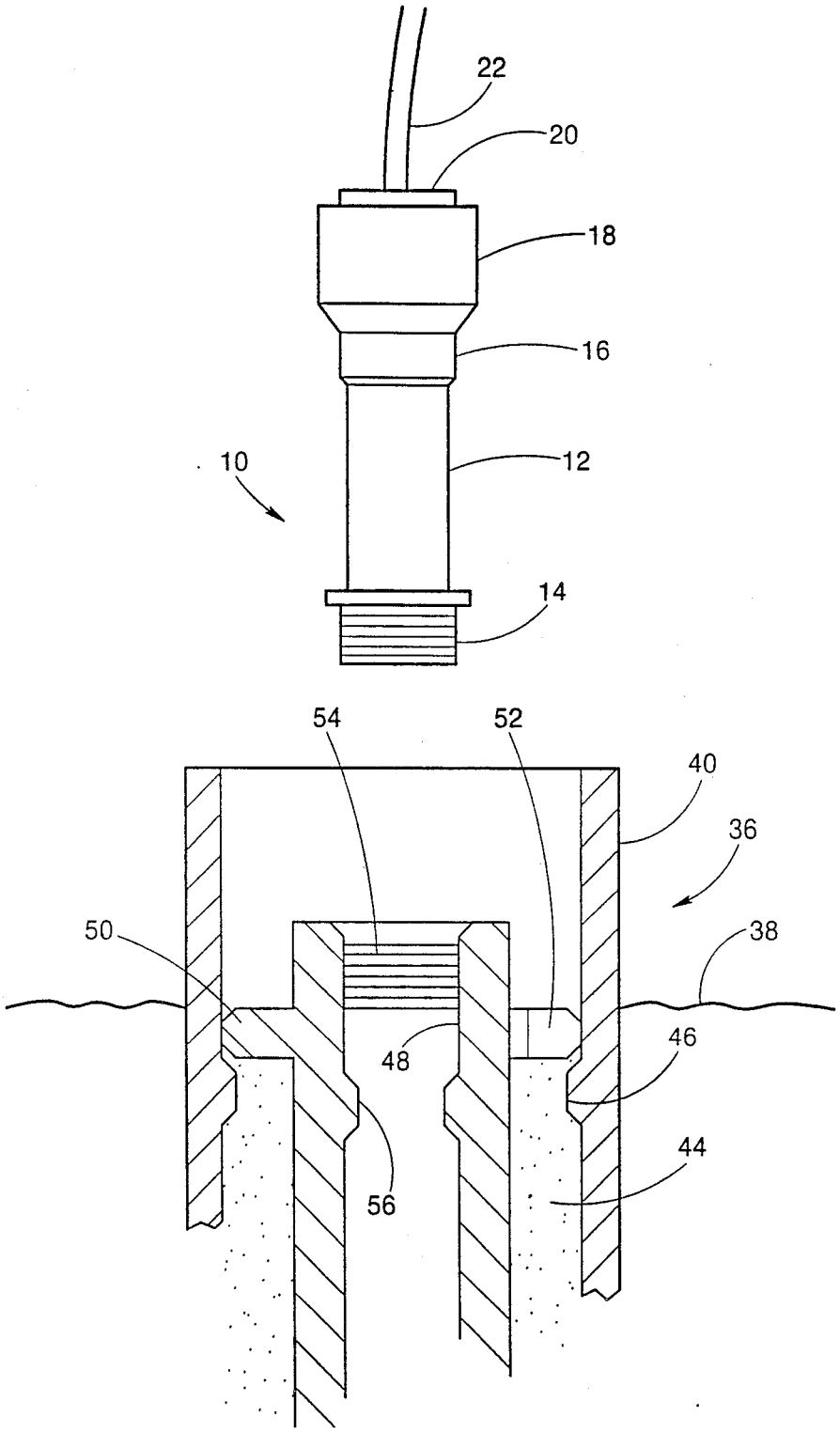
FIG. 4 is a side elevation view of the structure in FIG. 1 being lowered onto a wellhead (shown in cross section).
Figure 9:
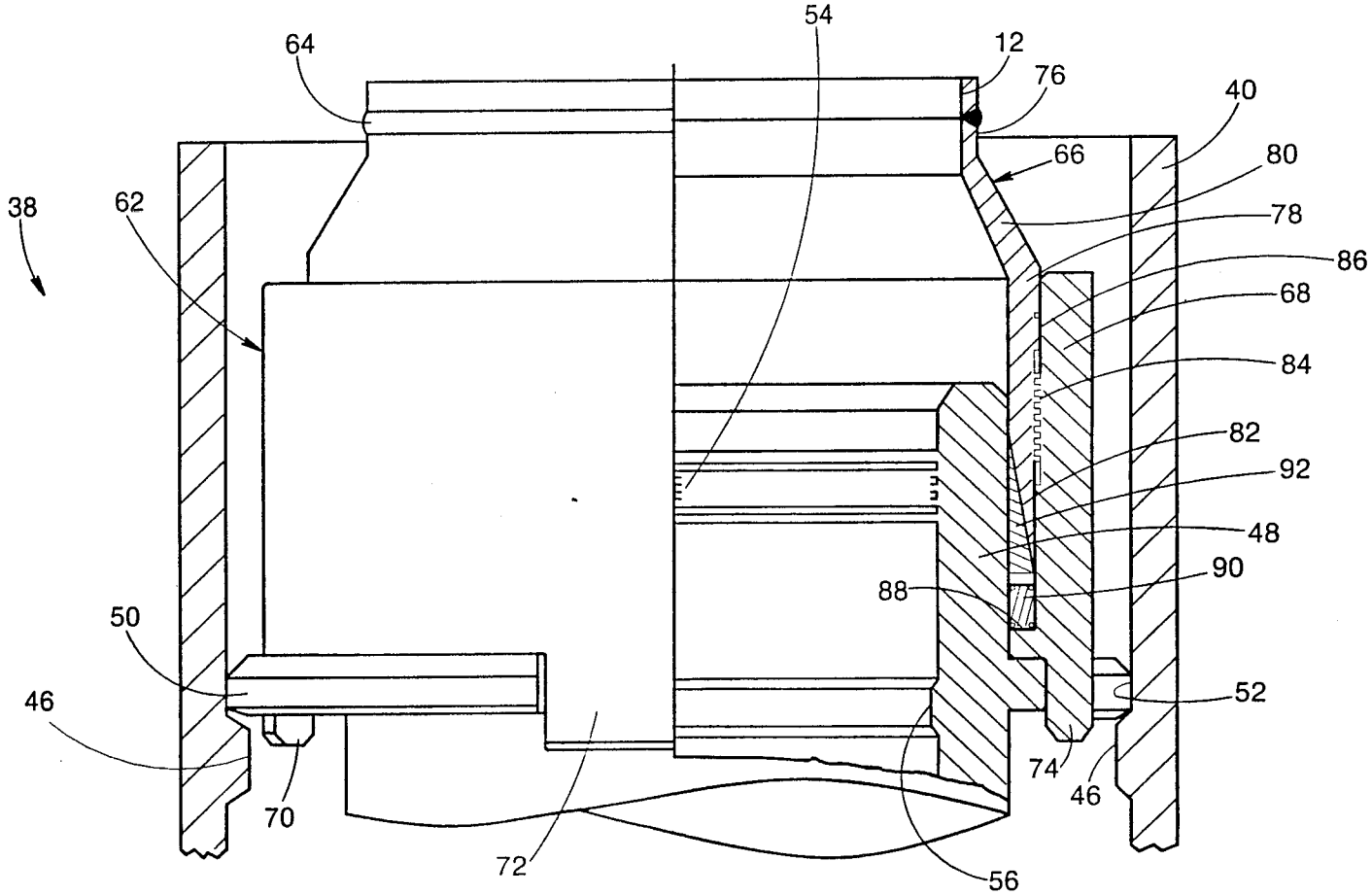
FIG. 9 is a cross-sectional view of a portion of the structure shown in FIG. 8 after contact with the wellhead has been made.

A close-up view of the top of the conductor and the wellhead 48 is shown in the lower portion of FIG. 4. Conductor 40 includes an annular shoulder 46 formed on its radially inner surface about the circumference thereof. A commercially available wellhead 48 is suspended from shoulder 46 by an annular collar 50 formed on the radially outer surface of the wellhead about its circumference. Casing 42 (in FIG. 3) is attached to and suspended from the lower end (not visible in FIG. 4) of wellhead 48. Included in collar 50 are a plurality of flow-by ports, like port 52. Such ports permit cement 44 to be pumped downwardly through the casing string and into the annulus between the casing string and the wellbore. Depending upon the manufacturer of the wellhead, the flow-by ports may be holes of one shape or another in the collar, or grooves cut from the outer edge of the collar as indicated in FIGS. 4, 9, and 10. The radially inner surface of the upper portion of wellhead 48 includes a set of threads 54 formed about the circumference thereof. Beneath the threads 54 is an annular shoulder 56 formed about the radially inner surface of wellhead 48.

Figure 5:
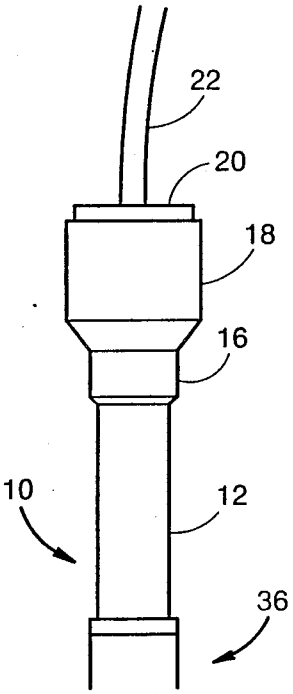
FIG. 5 is a view similar to FIG. 4 after contact with the wellhead is made.

Description will be made of the manner in which the apparatus shown in FIGS. 1 and 2 is used to connect a string of riser pipe to a wellhead. In FIG. 4 wellhead extension 12 and its associated structure have been lowered to a point just over wellhead. Such lowering is accomplished by engaging a running tool 20 with running tool receptacle 18 and running a string of drill pipe downwardly from the platform. In FIG. 4, the longitudinal axis of the wellhead extension 12, and thus of tieback tool 14, is aligned with the longitudinal axis of wellhead 48 to enable engagement of threads on tool 14 with threads 54. It can be seen that the drill pipe has been flexed in order to achieve such alignment which is normally accomplished by underwater divers (not shown). Such flexure is not possible with risers as they are restrained by the guides in the platform, and are too stiff anyway. Divers cannot bend a riser to make it align with the wellhead, but they can bend the drill pipe. After the wellhead extension and the wellhead are aligned as shown in FIG. 4, drill pipe 22 is lowered to land tie-back tool 14 in the wellhead as shown in FIG. 5.

After landing the tie-back in the wellhead, drill pipe 22 is rotated to threadably engage the tie-back tool with threads 54. Thereafter, drill string 22 is manipulated in a conventional manner to disengage running tool 20 from running tool receptacle 18 and the drill pipe and running tool are raised to the platform. At the platform, a string or riser pipe, of which pipe 24 is the lowermost pipe, is made up and lowered into the water over the wellhead.

Figure 7:
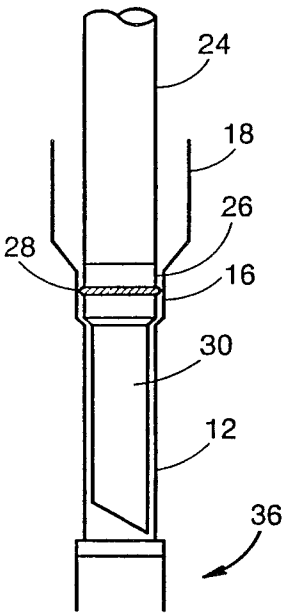
FIG. 7 is a view similar to FIG. 6 after engagement.
Figure 6:
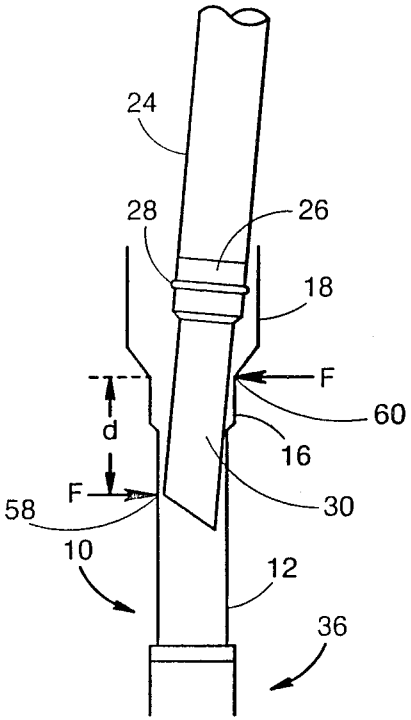
FIG. 6 is a semidiagramatic representation of portions of the invention shown in FIGS. 1 and 2 in the process engagement.

In FIG. 6, stinger 30 is shown entering wellhead extension 12 through connector body 16 and running tool receptacle 18. It can be seen that the longitudinal axis of the riser and stinger is approaching the extension-wellhead longitudinal axis at an angle. Because of this angle, stinger 30 contacts riser 12 at what are essentially points 58, 60. After such contacts are made, the riser string is slightly lowered thus increasing the downward force exerted by the stinger on the structure mounted on wellhead 36. Such downward force generates opposed parallel forces, indicated by the letters "F" and the arrows indicating the direction of force, at points 58, 60 which bends the stinger and riser into alignment with the axis of wellhead extension 12 thus permitting additional riser lowering to the position shown in FIG. 7. It is important in specifying the stinger outside diameter and length and inside diameter of wellhead extension 12 that all are selected to allow a sufficient distance between points 58, 60, known as "swallow," to effect the bending action of the stinger and riser as previously described. It is to be appreciated that a person having skill in the art could easily select appropriate dimensions for the length and diameters to assure sufficient distance between the parallel forces, designated by the letter "d". This distance must be sufficient to obtain bending action to enable the stinger and riser to seat as shown in FIG. 7.

Figure 8:
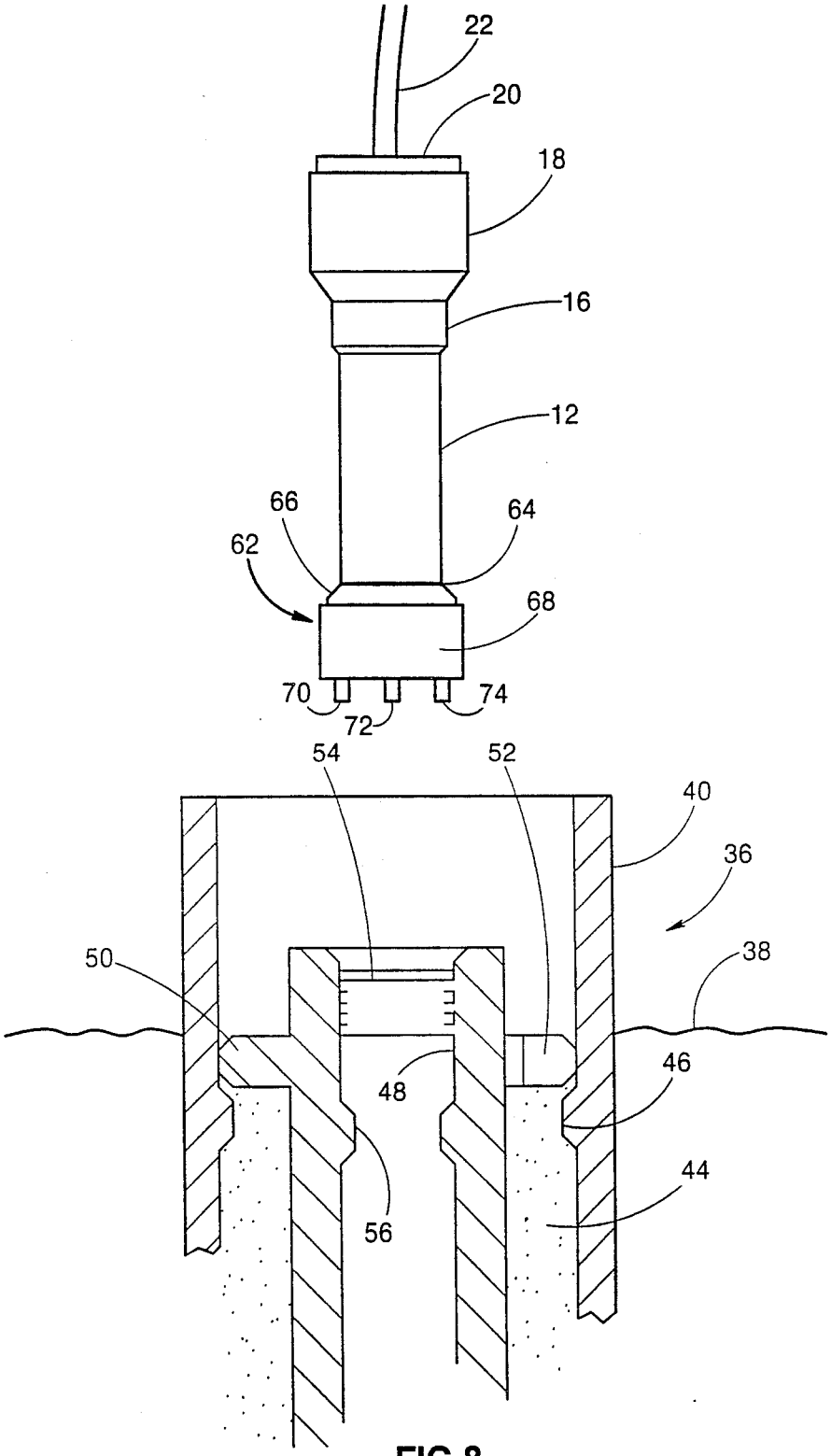
FIG. 8 is a side elevational view of a drill pipe and running tool and of a portion of the preferred embodiment of the apparatus of the instant invention being lowered onto a wellhead (shown in cross section).

Turning now to FIG. 8, structure which has been previously described herein and which appears in FIG. 8 is correspondingly numbered. In the embodiment of the apparatus of the invention shown in FIG. 8, instead of threaded tie-back tool 14 being mounted on the lower end of wellhead extension 12, an emergency tie-back tool 62 is welded to the lower end of wellhead extension 12 via a weld 64. Tool 62 includes a housing 66 which is welded by weld 64 to extension spool 12. A tubular nut 68 is threadably engaged via threads (not visible in FIG. 8) to housing 66. A plurality of lugs, like lugs 70, 72, 74, extend downwardly from the lower portion of nut 68.

FIG. 9 is a view with housing 66 received over wellhead 48.

Housing 66 of tie-back tool 62 includes a tubular upper portion 76, a tubular lower portion 78, and a frustoconical portion 80. Housing 66 includes a beveled lower end 82 and a threaded connection 84 with a tubular nut 68. A set of trash seals 86 is carried between the radially outer surface of housing 66 and the radially inner surface of tubular nut 68 about the circumference of each. In the configuration shown in FIG. 9, each of lugs 70, 72, 74 are received within a flow-by port in collar 50, like lug 74 is received within port 52.

An annular shoulder 88 is formed on the radially inner surface of tubular nut 68 about its circumference. In the view of FIG. 9, the lower surface of shoulder 88 rests upon the upper surface of collar 50. An annular elastomeric seal 90 is mounted on the upper surface of shoulder 88 about its circumference. Above seal 90 is a set of slips 92 which are mounted on the lower end of portion 78 of housing 66. Slips 92 are commercially available and are of the type which are used to form a firm connection between a cylindrically shaped object and a bore in which the object is received. Such a connection is made by the slips when they are compressed along their longitudinal axis.

In operation, tool 62 is lowered to a point just over wellhead 48 in the manner previously described for the embodiment of the invention illustrated in FIG. 5. When the axis of wellhead extension 12 is aligned with the longitudinal axis of wellhead 36, pipe 22 is lowered to fit lower portion 78 of housing 66 over the top of hanger 48. Further lowering brings the lower end of the lugs, like lugs 70, 72, 74, into contact with the top of collar 50. Thereafter, right-hand rotation is applied to the drill pipe thus rotating housing 27 and causing the lower end of the lugs to ride along the top of collar 50 until each lug is over a flow-by port, like port 52. When the lugs are each over an associated flow-by port, they drop into the port thus fixing tubular nut 68 against rotational movement relative to the hanger. After the lugs are engaged with the notches, additional right-hand rotation is applied to the drill pipe, thus moving housing 66 downward under the action of threaded connection 84. Such downward movement compresses slips 92 and seal 90 thus setting the slips and energizing the seal. Once the slips are set, the hanger and the nut are firmly fixed against relative movement and housing 66 is tightly threadably engaged with the nut thus forming a sealed joint between extension spool 12 and wellhead 48. At this point in the operation, the drill string is disengaged as previously described and riser pipe is connected to the wellhead as described in connection with FIGS. 6 and 7.

It is to be appreciated that tie-back toll 62 may be installed directly on the lower end of a string of riser pipe. In other words, upper portion 76 or tool 62 is welded by a weld, like weld 64, to the lower end of a string of riser pipe. Under circumstances in which the riser pipe string is in alignment with wellhead 48, it may be lowered onto the hanger and connected in the same fashion as described when tie-back tool 62 is on the lower end of wellhead extension 12.

Thus the present invention is well adapted to attain the advantages mentioned, as well as those inherent therein. It is to be appreciated that additions or modifications may be made to the methods and apparatus disclosed herein without departing from the spirit of the invention which is defined in the following claims.

What is claimed is:

1. Apparatus for connecting a tubular member to an underwater wellhead of the type including a casing pipe having an annular exterior collar which includes flow-by ports, said apparatus comprising:

a housing having an upper end and a lower end, the interior diameter of the lower end being of a size sufficient to fit over the wellhead on the upper end of said casing pipe, said wellhead being adapted for connection to said tubular member;

a set of helical threads formed on the radially outer side of said housing;

a substantially tubular nut threadably engaged with said helical threads;

a set of lugs mounted on the lower end of said nut, said lugs being adapted for engagement with said flow-by ports; and a set of slips mounted on the lower portion of said housing for fixedly engaging the exterior of said casing.

2. The apparatus of claim 1 wherein said apparatus further includes an annular seal mounted on the inner surface of said nut beneath said slips.

3. The apparatus of claim 2 wherein said apparatus further includes an annular shoulder formed on the radially inner surface of said nut beneath said seal.

4. The apparatus of claim 1 wherein said apparatus further includes an annular shoulder formed on the radially inner surface of said nut adjacent the lower end thereof, said radially inner nut surface, the upper surface of said shoulder and the lower surface of said housing defining an annular channel.

5. The apparatus of claim 4 wherein said slips and an annular seal are received with said channel.

6. A method for connecting a tubular member to an underwater wellhead comprising the steps of:

mounting a housing on the lower end of a tubular member;

threadably engaging a nut having downward extending lugs with the radially outer surface of said housing;

mounting a set of slips on the radially inner surface of said nut beneath said housing;

lowering the tubular member until said housing is fitted over the wellhead on the upper end of a casing pipe;

further lowering and rotating the tubular member until said lugs engage with flow-by ports in the annular collar formed about the radially outer circumference of said wellhead; and rotating said tubular member until said slips fixedly connect said nut to said casing pipe.

7. The method of claim 6 which further includes the step of providing an annular seal on the radially inner surface of said nut beneath said slips.

8. The method of claim 7 which further includes the step of providing an annular shoulder on the radially inner surface of said nut beneath said seal.

9. The method of claim 8 wherein the step of rotating said tubular member further comprises rotating the pipe to effect movement of said nut toward said housing thereby compressing said slips and said seal between said annular shoulder and the lower end of said housing.

10. Apparatus for connecting a tubular member to an underwater wellhead which includes a casing pipe having an annular exterior collar with at least one flow-by port, comprising:

a wellhead extension having an upper end and a lower end and a bore therethrough for permitting fluid communication between said ends;

means cooperable with the at least one flow-by port for sealably connecting said wellhead extension lower end to the underwater wellhead; and a stinger having an upper end adapted for connection to one end of said tubular member and further having a lower end receivable within said wellhead extension.

11. The apparatus of claim 10 wherein said stinger is generally cylindrically shaped.

12. The apparatus of claim 10 wherein the stinger length, outer diameter, and spool inner diameter are all sized so that when the stinger enters the spool at an angle, downward pressure places a lateral force on the stinger which tends to urge it into coaxial alignment with said spool.

13. The apparatus of claim 10 wherein said apapratus further includes means for sealably connecting the lower end of said tubular member to the upper end of said wellhead extension.

14. The apparatus of claim 10 wherein said means for sealably connecting comprises:

a housing having an upper end and a lower end, the interior diameter of the lower end being of a size sufficient to fit over the wellhead on the upper end of said casing pipe, said wellhead being adapted for connection to the lower end of said wellhead extension;

a set of helical threads formed on the radially outer side of said housing;

a substantially tubular nut threadably engaged with said helical threads on said housing;

a set of lugs mounted on the lower end of said nut, said lugs being adapted for engagement with said flow-by port; and a set of slips mounted on the lower portion of said housing for fixedly engaging the exterior of said casing.

15. The apparatus of claim 14 wherein said apparatus further includes an annular seal mounted on the inner surface of said nut beneath said slips.

16. The apparatus of claim 15 wherein said apparatus further includes an annular shoulder formed on the radially inner surface of said nut beneath said seal.

17. The apparatus of claim 16 wherein said slips and an annular seal are received within said channel.

18. The apparatus of claim 14 wherein said apparatus further includes an annular shoulder formed on the radialy inner surface of said nut adjacent the lower end thereof, said radialy inner nut surface of said shoulder and the lower surface of said housing defining an annular channel.

* * * * *